US010993489B2

(12) United States Patent
Hoppe et al.

(10) Patent No.: US 10,993,489 B2
(45) Date of Patent: May 4, 2021

(54) GLOVE

(71) Applicant: Milwaukee Electric Tool Corporation, Brookfield, WI (US)

(72) Inventors: Christopher S. Hoppe, Milwaukee, WI (US); Steven W. Hyma, Milwaukee, WI (US); Matthew Vargo, Milwaukee, WI (US); Grant T. Squiers, Cudahy, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 15/046,597

(22) Filed: Feb. 18, 2016

(65) Prior Publication Data

US 2016/0235140 A1 Aug. 18, 2016

Related U.S. Application Data

(60) Provisional application No. 62/117,622, filed on Feb. 18, 2015, provisional application No. 62/234,131, filed on Sep. 29, 2015.

(51) Int. Cl.
*A41D 19/015* (2006.01)

(52) U.S. Cl.
CPC ..... *A41D 19/01564* (2013.01)

(58) Field of Classification Search
CPC ..... A41D 19/01547; A41D 19/01576; A41D 19/0037; A41D 19/0034; A41D 2400/80; A41D 19/002; A41D 19/015; G06F 3/014; A63B 71/146
USPC ..... 2/19, 161.3, 162, 161.6, 161.1, 161.8; 15/227; 602/21, 22; 345/173, 156; D2/618, 615, 614, 617; D29/117.2
See application file for complete search history.

(56) References Cited

U.S. PATENT DOCUMENTS 2,295,507 A * 9/1942 Wells, Jr. ..... 2/161.6
2,582,240 A * 1/1952 Dumas ..... A41D 19/00 2/161.1

(Continued)

FOREIGN PATENT DOCUMENTS

CN 204483154 7/2015

OTHER PUBLICATIONS

Akona 1MM Bug Hunter Premuim ArmorTex Gloves for Lobster Diving (Large); printed Apr. 19, 2007; Amazon.com, 4 pages.*

(Continued)

*Primary Examiner* — Jillian K Pierorazio
(74) *Attorney, Agent, or Firm* — Reinhart Boerner Van Deuren s.c.

(57) ABSTRACT

A glove including a top surface, a bottom surface opposite the top surface, and the bottom surface is configured to interface with an object being gripped by a user. The glove also includes an index finger portion configured to receive an index finger of the user. The index finger portion includes a knuckle configured to pivot about an axis. The glove further includes a gripping portion coupled to the index finger portion between the top and bottom surfaces. The gripping portion includes a first notch adjacent the top surface and a second notch adjacent the bottom surface. The first notch defines a first angle, and the second notch defines a second angle, wherein the first angle increases and the second angle decreases as the knuckle pivots about the axis.

5 Claims, 7 Drawing Sheets

(56) References Cited

U.S. PATENT DOCUMENTS 4,146,935 A * 4/1979 Hinton ..... A41D 19/01547 2/161.3
4,942,626 A * 7/1990 Stern ..... A61B 42/10 2/161.7
6,035,444 A * 3/2000 McGrew ..... A41D 19/0017 2/16
6,041,438 A * 3/2000 Kirkwood ..... A41D 19/0034 2/161.1
6,141,643 A 10/2000 Harmon
6,279,164 B1 * 8/2001 Martin ..... A41D 19/01552 2/161.1
6,279,166 B1 * 8/2001 Schild ..... A41D 19/0048 2/163
6,651,255 B1 * 11/2003 Schild ..... A41D 19/015 2/160
6,721,960 B1 * 4/2004 Levesque ..... A41D 19/01523 2/161.1
6,760,924 B2 * 7/2004 Hatch ..... A41D 19/01558 2/161.5
D528,264 S * 9/2006 Mattesky ..... D2/619
D560,036 S * 1/2008 VanErmen ..... D29/117.2
D608,978 S * 2/2010 Votel ..... D2/617
8,490,217 B2 * 7/2013 Safford ..... A41D 19/015 2/161.6
8,528,117 B2 9/2013 Asiaghi
D696,467 S 12/2013 Nelson
8,605,049 B2 12/2013 Spencer
D703,389 S 4/2014 Ruminski
D722,208 S 2/2015 Votel et al.
D745,746 S 12/2015 Hughes et al.
D778,531 S 2/2017 Hyma et al.
D788,402 S 6/2017 Votel et al.
D789,030 S 6/2017 Votel et al.
D794,901 S 8/2017 Vargo et al.
D796,779 S * 9/2017 Votel ..... D2/619
2004/0025227 A1 * 2/2004 Jaeger ..... A41D 19/01558 2/161.6
2005/0231471 A1 10/2005 Mallard et al.
2007/0113317 A1 * 5/2007 Garneau ..... A63B 71/14 2/161.1
2007/0136928 A1 * 6/2007 Dolenak ..... A41D 19/0044 2/162
2009/0158495 A1 * 6/2009 Flynn ..... A42B 3/26 2/160
2009/0205104 A1 * 8/2009 Kim ..... A63B 71/146 2/161.3
2009/0275418 A1 * 11/2009 Whitehead, II ..... A63B 71/148 473/60
2010/0090966 A1 * 4/2010 Gregorio ..... A41D 19/0024 345/173
2011/0277215 A1 11/2011 Lee et al.
2012/0042429 A1 * 2/2012 Zare ..... A61B 42/10 2/20
2012/0128995 A1 * 5/2012 Leto ..... C09D 175/04 428/473
2012/0131725 A1 * 5/2012 Copeland ..... A63B 71/143 2/161.1
2012/0157263 A1 6/2012 Sivak et al.
2012/0198598 A1 * 8/2012 Cohen ..... A41D 19/002 2/160
2012/0227158 A1 * 9/2012 Ashworth ..... A41D 19/0065 2/164
2012/0324620 A1 12/2012 Murphy
2013/0025327 A1 1/2013 Cornish et al.
2013/0036529 A1 2/2013 Salter et al.
2013/0104278 A1 5/2013 Christopherson et al.
2013/0104285 A1 5/2013 Nolan
2013/0180027 A1 7/2013 Rock
2013/0191962 A1 8/2013 Alves
2014/0028538 A1 1/2014 Shin et al.
2014/0033392 A1 * 2/2014 Bulan ..... A41D 19/01547 2/16
2014/0033396 A1 * 2/2014 Hatfield ..... A41D 19/001 2/163
2014/0157486 A1 6/2014 Del Rio Audibert et al.
2014/0165262 A1 6/2014 Klausner et al.
2014/0165658 A1 6/2014 Cornish et al.
2014/0189925 A1 * 7/2014 Ramirez ..... A41D 19/01547 2/16
2014/0215685 A1 * 8/2014 Bush ..... A63B 71/146 2/161.1
2014/0259285 A1 9/2014 Andrews et al.
2014/0283559 A1 9/2014 Andrews et al.
2015/0029153 A1 1/2015 Williams et al.
2015/0119200 A1 4/2015 Jones
2015/0189929 A1 * 7/2015 Ramirez ..... A41D 19/01547 2/16
2016/0100637 A1 * 4/2016 Anderson ..... A41D 19/0024 2/161.8

OTHER PUBLICATIONS

"Elastocon 2810", retreived. Jul. 30, 2018, https://www.elastocontpe.com/Selector-Guide/?DownloadID=1.*

* cited by examiner

GLOVE

CROSS-REFERENCE TO RELATED APPLICATIONS

This application claims priority to U.S. Provisional Application No. 62/117,622, filed Feb. 18, 2015, and to U.S. Provisional Application No. 62/234,131, filed Sep. 29, 2015, the entire contents of which are incorporated herein by reference.

FIELD OF THE INVENTION

The present invention relates to gloves, and more particularly to work gloves.

SUMMARY

In one aspect, the invention provides a glove including a top surface and a bottom surface opposite the top surface with the bottom surface configured to interface with an object being gripped by a user. The glove also includes an index finger portion configured to receive an index finger of the user. The index finger portion includes a knuckle configured to pivot about an axis. The glove further includes a gripping portion coupled to the index finger portion between the top and bottom surfaces. The gripping portion includes a first notch adjacent the top surface and a second notch adjacent the bottom surface. The first notch defines a first angle, and the second notch defines a second angle, wherein the first angle increases and the second angle decreases as the knuckle pivots about the axis.

In another aspect, the invention provides a glove including a top surface and a bottom surface opposite the top surface with the bottom surface configured to interface with an object being gripped by a user. The glove also includes a thumb portion configured to receive a thumb of the user and an index finger portion configured to receive an index finger of the user. The index finger portion includes a knuckle configured to pivot about an axis. The glove further includes a gripping portion coupled to the thumb portion and the index finger portion. The gripping portion includes a first notch adjacent the top surface and a second notch adjacent the bottom surface. The first and second notches are associated with the axis of the index finger portion. The glove includes a capacitive material coupled to the knuckle of the index finger portion. The capacitive material is configured to bend about the axis.

Figure 1:
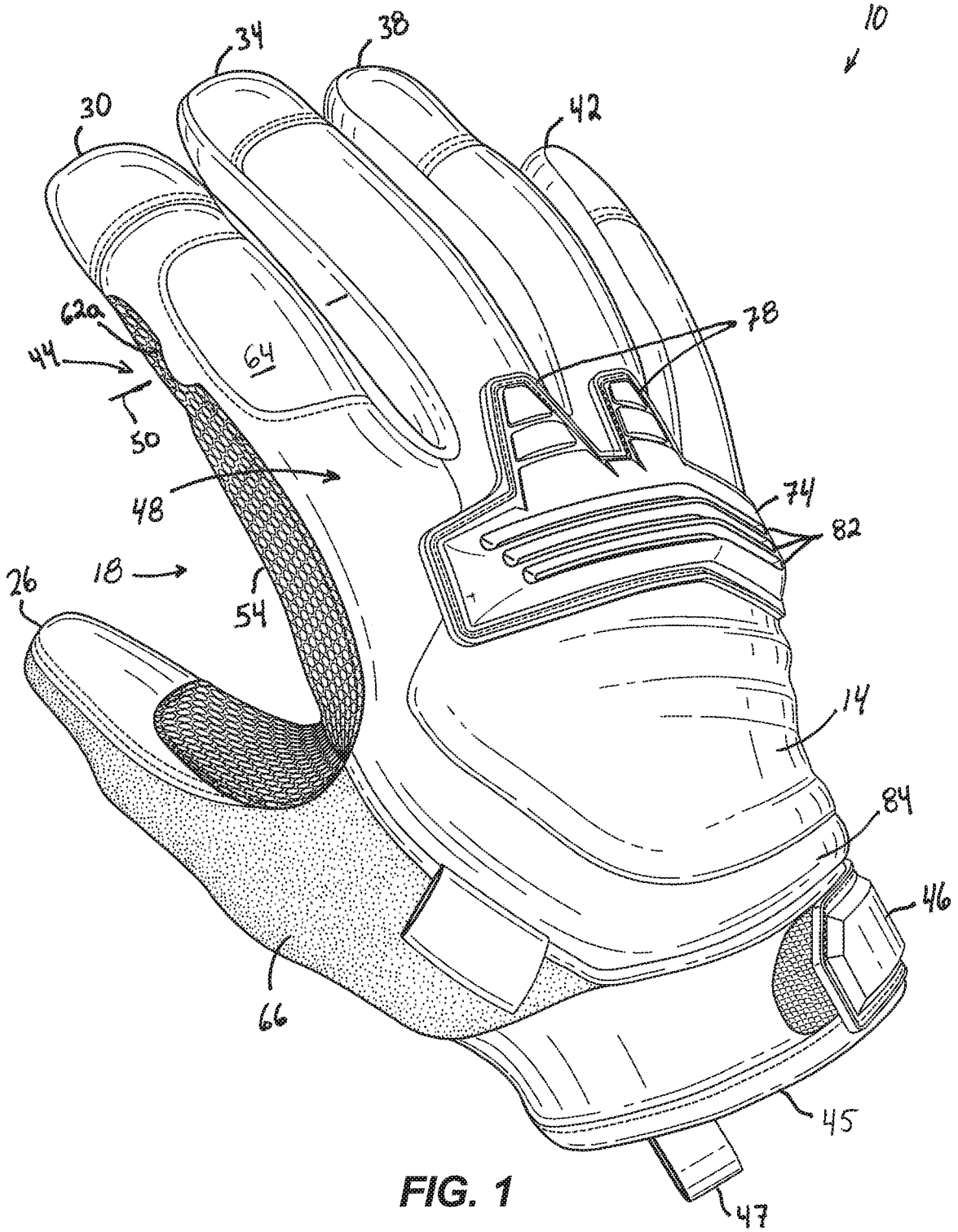
FIG. 1 is a top perspective view of a right hand glove according to an embodiment of the invention.
Figure 2:
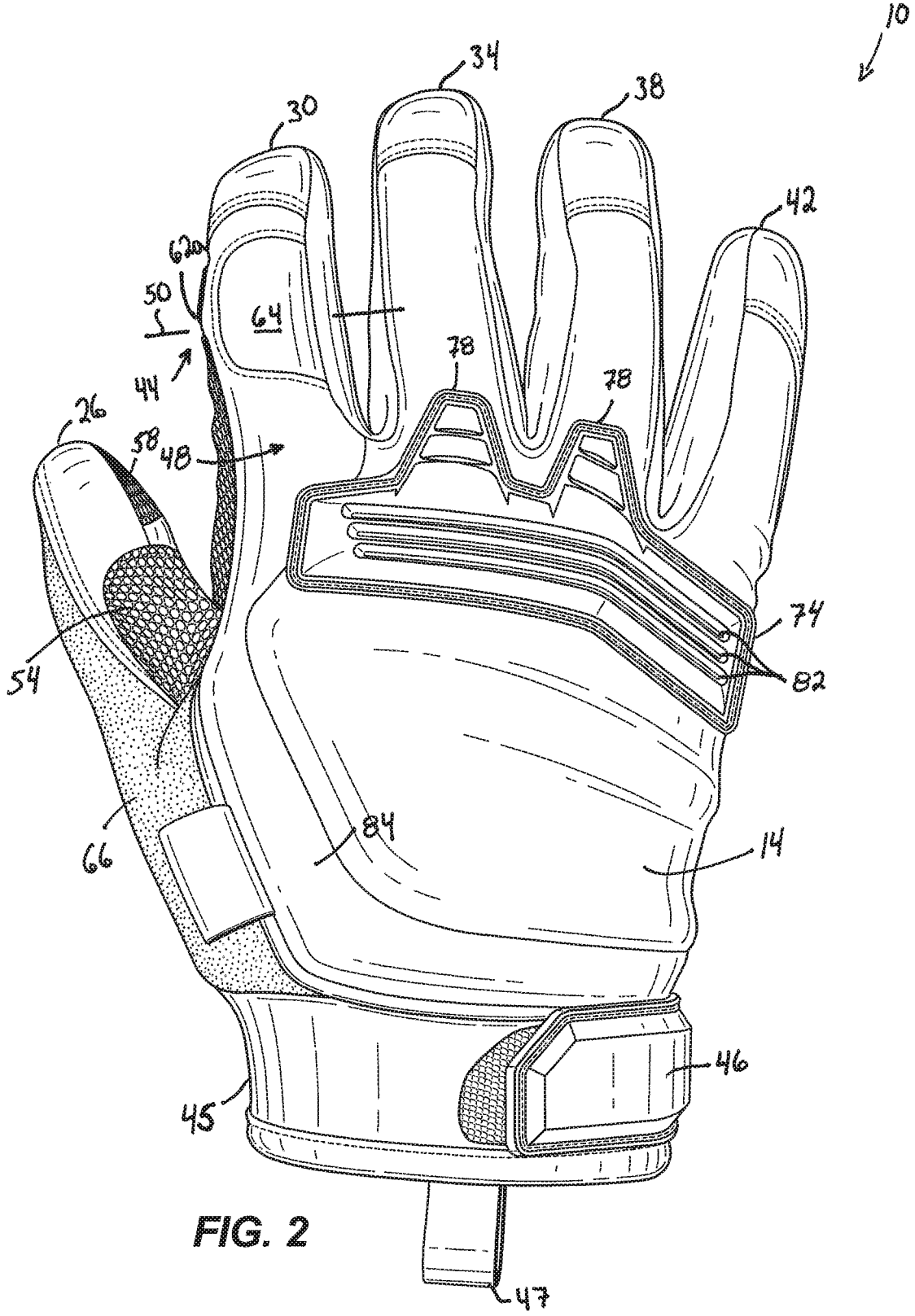
FIG. 2 is a top view of the right hand glove of FIG. 1.
Figure 3:
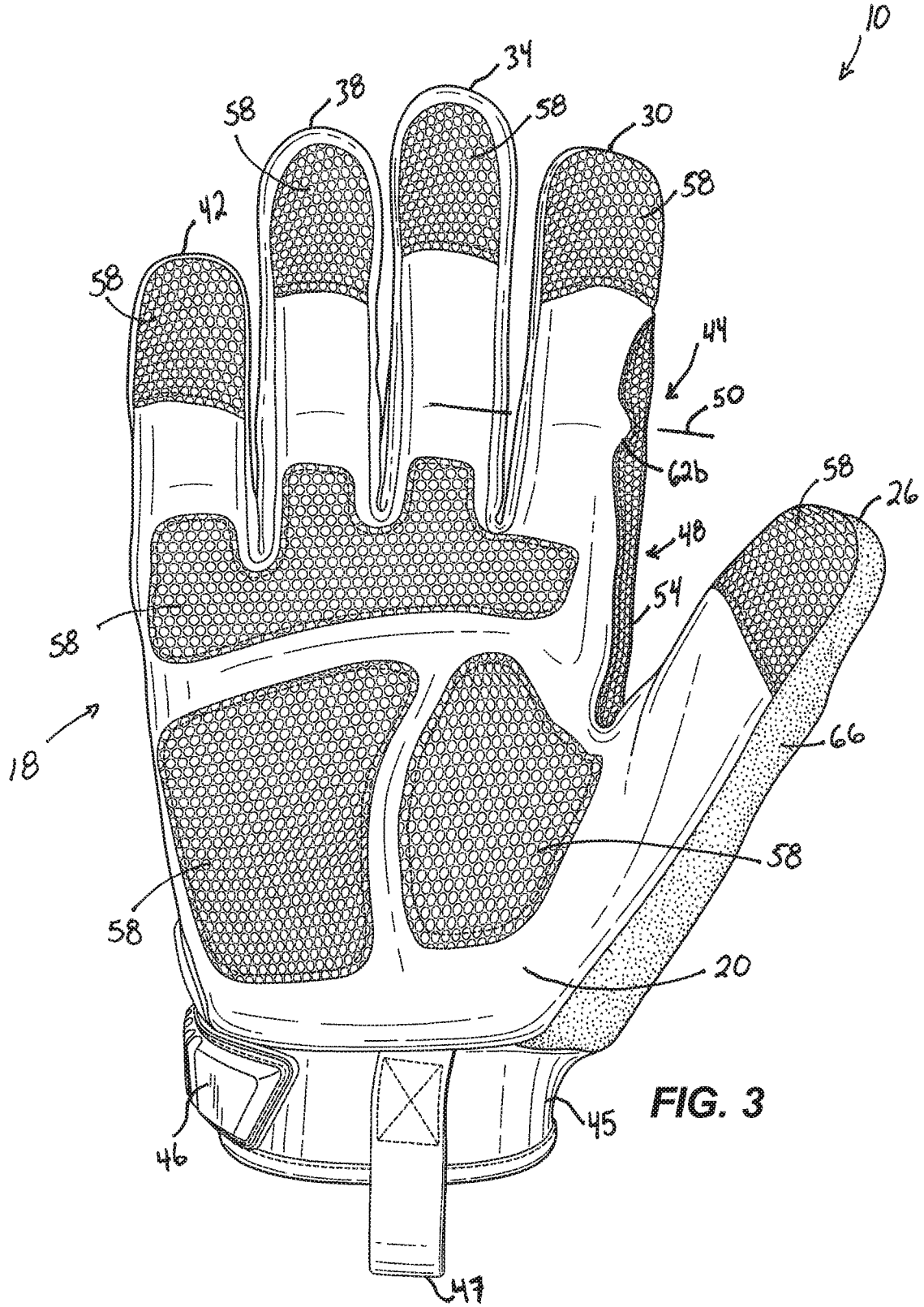
FIG. 3 is a bottom view of the right hand glove of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-8 illustrate a glove 10 (e.g., a work glove) according to one embodiment. The illustrated glove 10 includes a top surface 14 opposite a bottom surface 18 and a palm portion 20 associated with the bottom surface 18. The illustrated bottom surface 18 is configured to interface with an object being gripped. In the illustrated embodiment, the bottom surface 18 is substantially made from synthetic leather, and the top surface 14 is substantially made from spandex. In other embodiments, the surfaces 14, 18 may be of different material.

A thumb portion 26, an index finger portion 30, a middle finger portion 34, a ring finger portion 38, and a little finger portion 42 are configured to receive a respective finger of a user's hand after the user's hand is inserted through a cuff 45. In other embodiments, the portions 26, 30, 34, 38, 42 may not include a closed end or tip (e.g., may include an open end) such that the user's thumb and fingers extend through and beyond the portions 26, 30, 34, 38, 42 (e.g., a framer or fingerless glove design). The illustrated cuff 45 includes a strap 46 that is removably attached to the cuff 45 by a Velcro® closure, thereby allowing the cuff 45 to be adjusted to various sized wrists of a user's hand. In other embodiments, the strap 46 is replaced with an elastic band that forms over a wrist of the user's hand. A tab 47 is also attached to a portion of the cuff 45 adjacent the bottom surface portion 18 to aid in pulling the glove 10 over the user's hand. In the illustrated embodiment, the strap 46 is manufactured from rubber, but in other embodiments the strap 46 may be manufactured from a fabric material.

The illustrated index finger portion 30 includes a first knuckle 44 and a second knuckle 48 with the second knuckle 48 located at a base of the index finger portion 30 away from the end or tip of the index finger portion 30. The first knuckle 44 is located between the second knuckle 48 and the tip of the index finger portion 30. The first knuckle 44 generally pivots about an axis 50, for example, when a user bends their index finger. Although not illustrated, the finger portions 34, 38, 42 also pivot about a similar axis to the axis 50, and in other embodiments, a slot or break in material is associated with the axis of the finger portions 34, 38, 42. For example, an elastic material may form a portion of the finger portions 34, 38, 42 that bends about the axis.

In the illustrated embodiment, a capacitive material 64 is associated with the first knuckle 44. In particular, a midpoint of the capacitive material 64 is configured to bend about the axis 50. In other embodiments, the axis 50 may be offset relative to the midpoint of the capacitive material 64. The illustrated capacitive material 64 includes conductive particles (e.g., graphite) penetrated into a synthetic material (e.g., composition of spandex and polyurethane). In other embodiments, the capacitive material 64 may include different types of materials. The capacitive material 64 is configured to operate a capacitive sensing electronic device (e.g., a smartphone) by transferring the capacitance of the user's finger to the electronic device. In other embodiments, the capacitive material 64 may be located on another knuckle of another finger portion 34, 38, 42.

Figure 8:
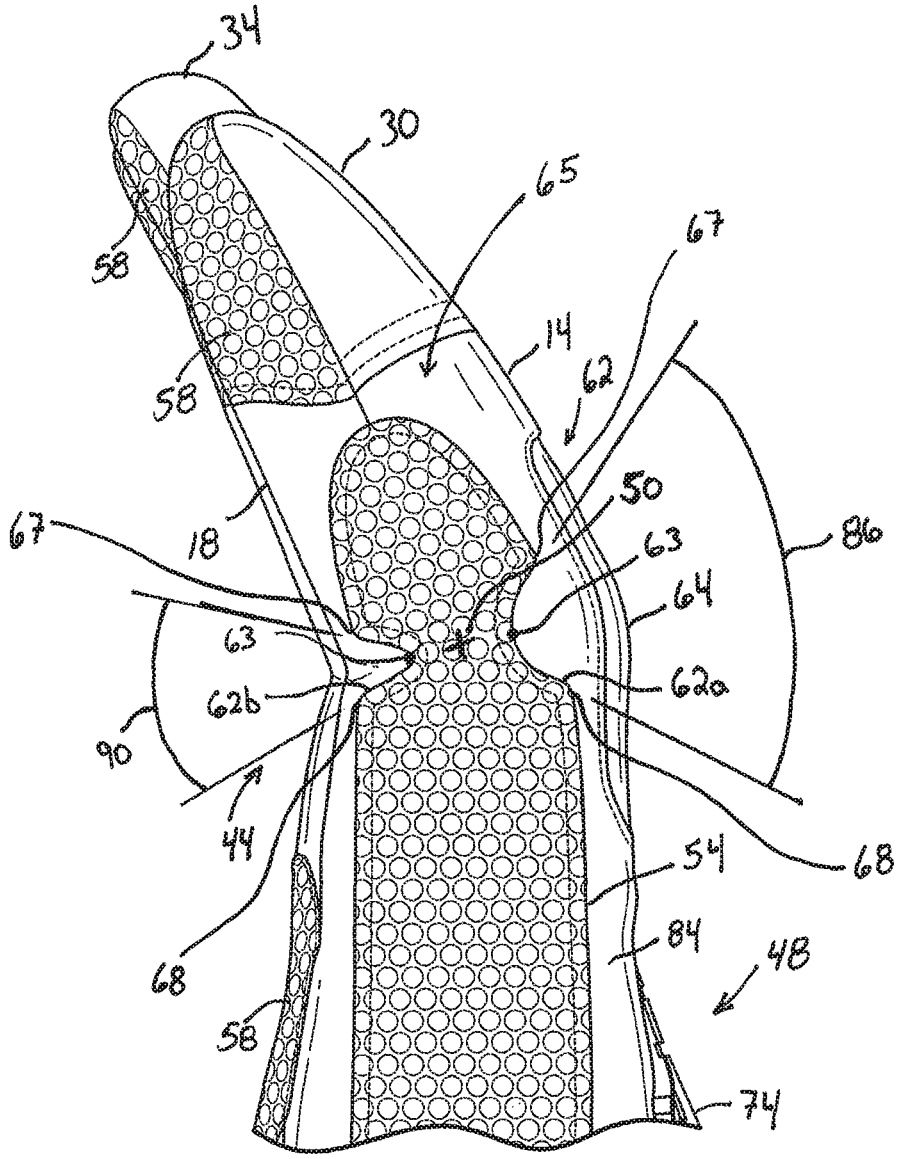
FIG. 8 is a detailed view of FIG. 4 illustrating a portion of an index finger of the right hand glove being bent.

A side gripping portion 54 is coupled between the thumb portion 26 and the index finger portion 30 and also extends between the top surface 14 and the bottom surface 18. In other words, the side gripping portion 54 is generally located on a side of the thumb portion 26 and a side of the index finger portion 30. The illustrated gripping portion 54 provides an increased coefficient of friction between the glove 10 and an object being gripped to reduce slip therebetween. In the illustrated embodiment, the gripping portion 54 is manufactured from an anti-slip rubber compound (e.g., Armortex® (NL-8050)), which includes greater rigidity than the surrounding material of the index finger portion 30. In other embodiments, the side gripping portion 54 may be of different material that is more rigid than the material of the index finger portion 30. The illustrated gripping portion 54 includes flexible notches 62 with a first notch 62*a* adjacent the top surface 14 and a second notch 62*b* opening opposite from the first notch 62*a* and positioned adjacent the bottom surface 18. In other embodiments, the gripping portion 54 may only include one notch 62. An apex 63 of each notch 62 is curvilinear or U-shaped (FIG. 4); however, in other embodiments, the apex 63 may be V-shaped. Each apex 63 of the illustrated notches 62 is located on a side surface 65 (FIG. 8) of the first knuckle 44 of the index finger portion 30 (the side surface 65 is positioned between the top surface 14 and the bottom surface 18) so that the notches 62 generally align with the axis 50. In particular, the axis 50 is positioned between the apexes 63 of the notches 62. In addition, first ends 67 and second ends 68 of the notches 62*a*, 62*b* are located on the side surface 65 of the first knuckle 44 (FIG. 8).

With reference to FIGS. 3-7, the bottom surface 18 includes bottom gripping portions 58, similar to the side gripping portion 54. In one embodiment, the gripping portions 58 can also include padding or cushioning material to decrease vibrational forces transmitted to the glove 10 and to improve comfort of wearing the glove 10. The bottom gripping portions 58 are located on the palm portion 20, at ends of the thumb and finger portions 26, 30, 34, 38, 42, and at an area between the palm portion 20 and the finger portions 30, 34, 38, 42.

With reference to FIGS. 1-5 and 7, the illustrated glove 10 also includes an absorbent portion 66 extending from the cuff 45 along a side of the thumb portion 26 and also extending between the top surface 14 and the bottom surface 18. In other words, the absorbent portion 66 defines a portion of the thumb portion 26. The illustrated absorbent portion 66 includes a loop material (e.g., a terrycloth material) configured to absorb moisture. For example, as the absorbent portion 66 contacts skin of the user (e.g., a user's forehead) the moisture thereon is absorbed by the absorbent portion 66. In other embodiments, the absorbent portion 66 may be of a different absorbent material.

With reference to FIGS. 1, 2, 4 and 5, a guard 74 is coupled to the top surface 14 and is positioned at a base of the finger portions 30, 34, 38, 42. The illustrated guard is configured to protect the user's hand. The illustrated guard 74 includes protrusions 78 with one protrusion extending towards the middle finger portion 34 and another protrusion 78 extending towards the ring finger portion 38. In other embodiments, the guard 74 may include more or less than two protrusions 78, and/or the protrusions 78 may extend towards other finger portions. Line features 82 defined with contrasting color to the guard 74 extend between the index finger portion 30 and the little finger portion 42. For example, the line features 82 are red in color (e.g., Pantone 18-1763 TCX), whereas the guard 74 is substantially black in color. In addition, an accent feature 84 is positioned on the top surface 14 and extends from the index finger portion 30 to the cuff 45 and partially surrounds the capacitive material 64. The illustrated accent feature 84 also abuts the side gripping portion 54 and the absorbent portion 66. The accent feature 84 is illustrated in contrasting color with bordering portions of the glove 10. For example, the accent feature 84 is red in color (e.g., Pantone 18-1763 TCX) with the bordering areas generally black or grey in color. In other embodiments, an accent stitching (e.g., red stitching) may surround the capacitive material 64. In further embodiments, the accent feature 84 may be positioned and oriented differently on the top surface 14 of the glove 10 (e.g., the accent feature 84 may extend between the middle finger portion 34 and the little finger portion 42).

Figure 4:
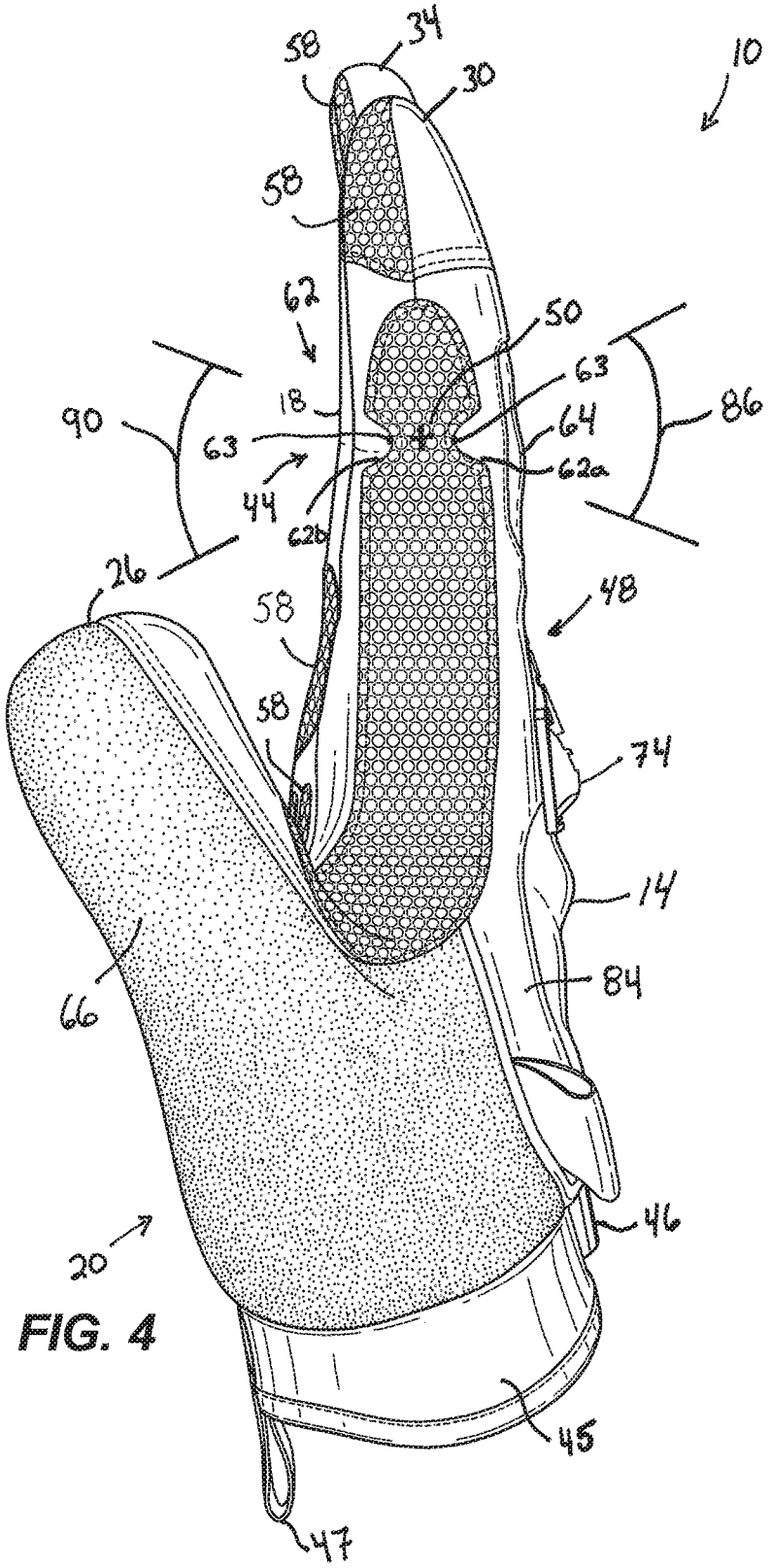
FIG. 4 is a left side view of the right hand glove of FIG. 1.
Figure 5:
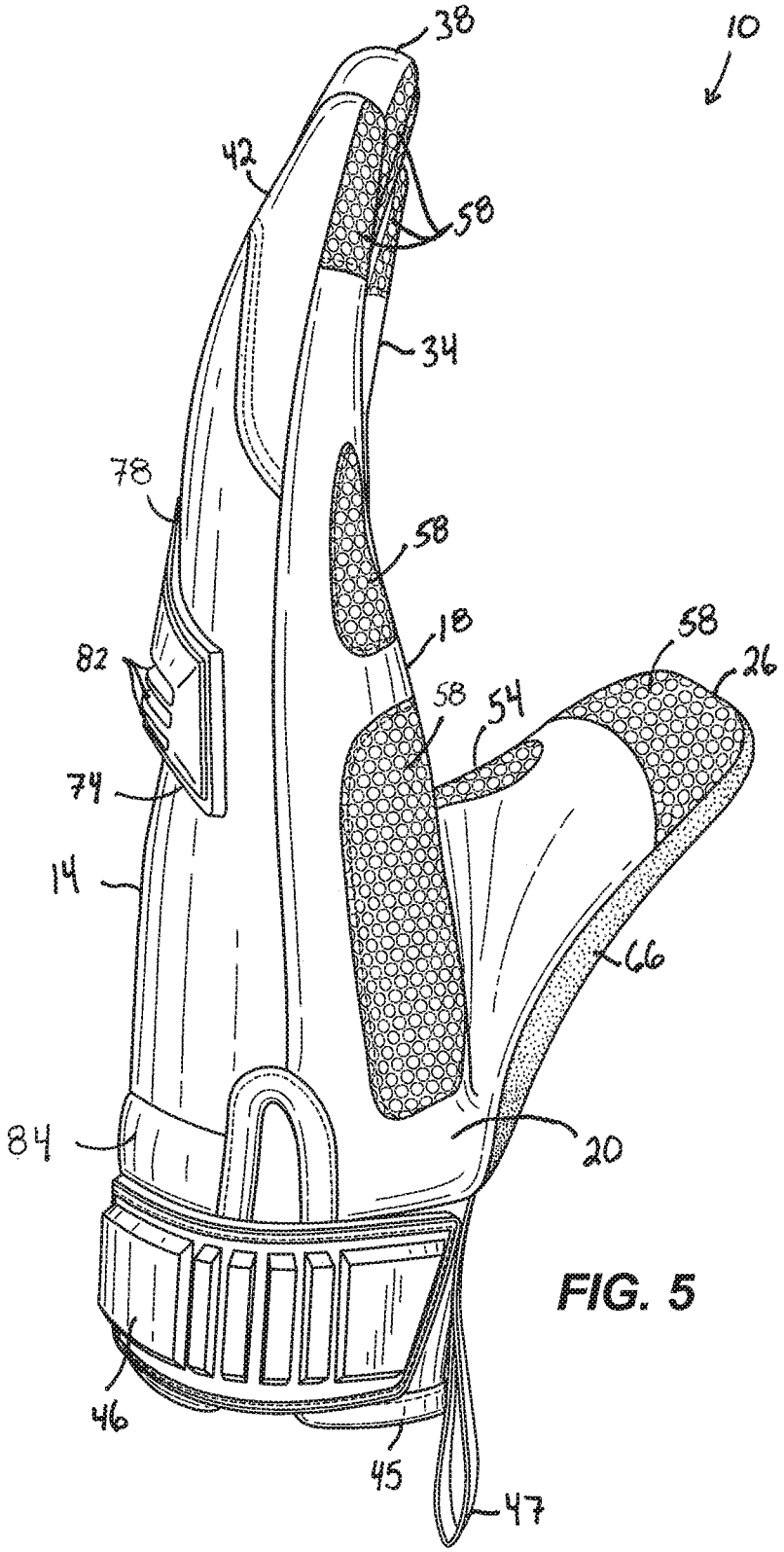
FIG. 5 is a right side view of the right hand glove of FIG. 1.
Figure 6:
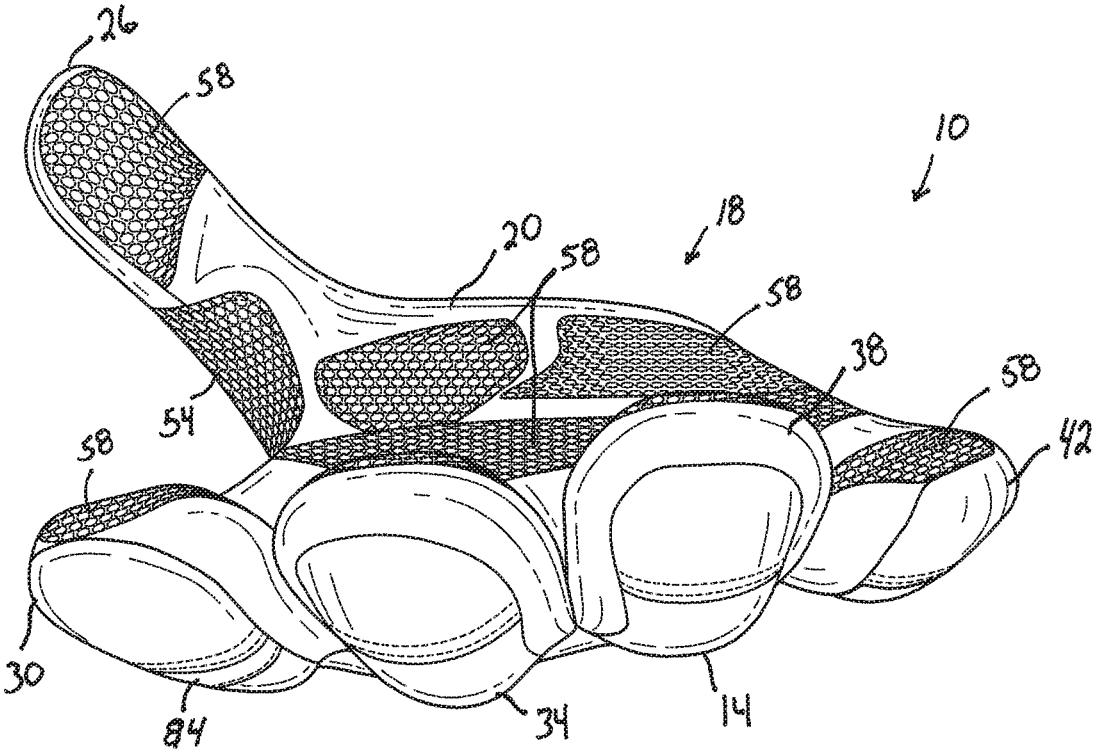
FIG. 6 is a front view of the right hand glove of FIG. 1.
Figure 7:
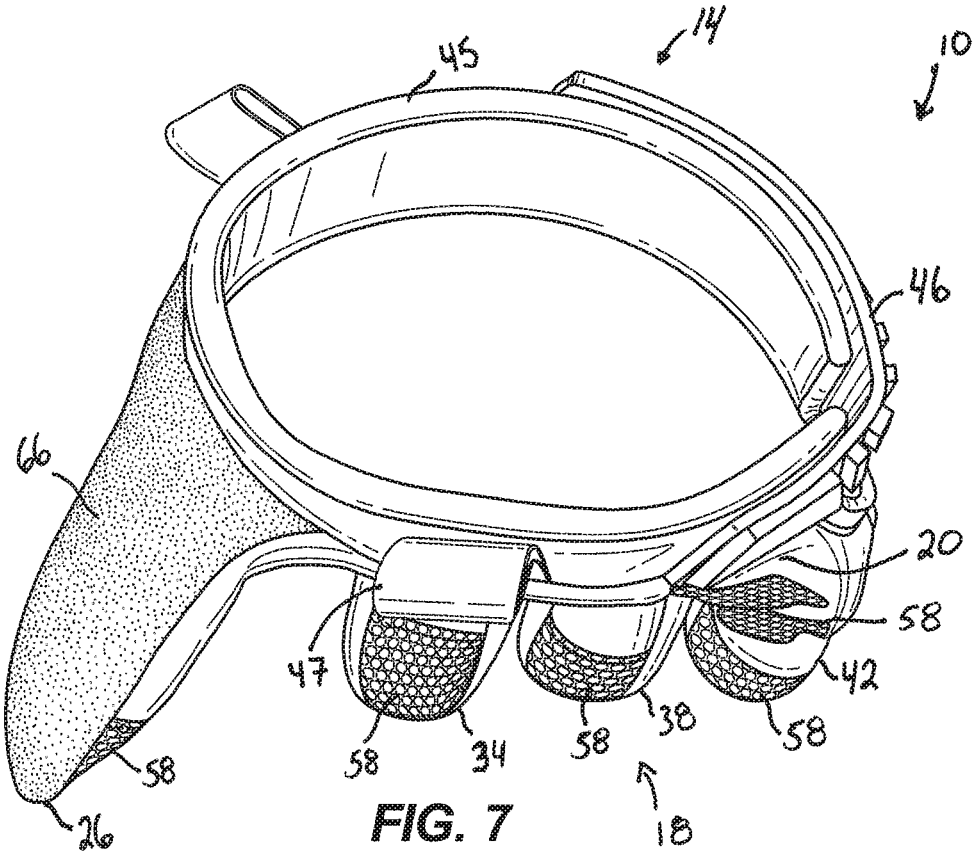
FIG. 7 is a rear view of the right hand glove of FIG. 1.

In operation, as the user's hand is within the glove 10 and the user's index finger is oriented straight (e.g., not bent), the notch 62*a* defines a first angle 86 and the notch 62*b* defines a second angle 90 with the angles 86, 90 being substantially the same (FIG. 4). As the user bends or pivots their index finger about the axis 50, the first knuckle 44 also pivots about the axis 50 thereby increasing the first angle 86 and decreasing the second angle 90 (FIG. 8). Because the side gripping portion 54 is more rigid than other portions of the index finger portion 30, the notches 62 are flexible so that the side gripping portion 54 does not impede (e.g., reduce resistance) bending of the first knuckle 44. As the user bends their index finger, the capacitive material 64 and the notches 62 concurrently bend about the axis 50 to extend their knuckle (e.g., the first knuckle 44) to operate the electric device by the capacitive material 64.

Although the invention has been described in detail with reference to certain preferred embodiments, variations and modifications exist within the scope and spirit of one or more independent aspects of the invention as described.

The invention claimed is:

1. A work glove comprising:

a top surface;

a bottom surface opposite the top surface;

a middle finger portion configured to receive a middle finger of a user;

a ring finger portion configured to receive a ring finger of a user;

a little finger portion configured to receive a little finger of a user;

an index finger portion having a first material and configured to receive an index finger of the user, the index finger portion comprising a side positioned between the top surface and the bottom surface, the index finger portion comprising:

a first knuckle portion;

a second knuckle portion located at a base of the index finger portion, wherein the first knuckle portion is located between the second knuckle portion and a tip of the index finger portion and configured to bend about an axis; and a thumb portion configured to receive a thumb of the user, the thumb portion comprising a side between the top surface and the bottom surface and facing the side of the index finger;

a contiguous side gripping portion extending from the side of the thumb portion to the side of the index finger portion at the first knuckle portion, the side gripping portion comprising:

a second material having a coefficient of friction greater than a coefficient of friction of the first material and a rigidity greater than a rigidity of the first material;

a first notch defined in the side gripping portion facing the top surface and comprising an apex located on the side of the index finger at the first knuckle portion, wherein the apex of the first notch is aligned with the axis of the first knuckle portion; and a second notch defined in the side gripping portion facing the bottom surface and comprising an apex located on the side of the index finger at the first knuckle portion, wherein the apex of the second notch is aligned with the axis of the first knuckle portion;

a plurality of bottom gripping portions located on the bottom surface, wherein at least one bottom gripping portion is located on each of a palm portion, an end of each of the index finger portion, the middle finger portion, the ring finger portion and the little finger portion and an area between the palm portion and the index finger portion, middle finger portion, ring finger portion and little finger portion; and a contiguous guard portion coupled to the top surface and located at bases of the index finger portion, the middle finger portion, the ring finger portion and the little finger portion, the guard portion comprising:

a first protrusion extending toward middle finger portion; and a second protrusion extending toward the ring finger portion.

2. The work glove of claim 1, wherein the plurality of bottom gripping portions comprise a padding material configured to decrease transmission of vibrational forces to a hand of the user.

3. The work glove of claim 2, further comprising a capacitive material located at a top surface of the first knuckle portion of the index finger, wherein the capacitive material is configured to operate a capacitive sensing electronic device, and wherein a midpoint of the capacitive material is positioned to align with the first and second notches of the side gripping portion such that the capacitive material is configured to bend about the axis associated with the first knuckle portion of the index finger.

4. The work glove of claim 3, wherein the bottom surface comprises a synthetic leather material, the top surface comprises a spandex material and the side gripping portion comprises an anti-slip rubber compound.

5. The work glove of claim 4, further comprising an absorbent portion extending along a side of the thumb portion opposite the side gripping portion located on the thumb portion, the absorbent portion comprising a loop material configured to absorb moisture from a user's skin.

* * * * *